US005351356A

United States Patent [19]

Townsend, Jr.

[11] Patent Number: 5,351,356

[45] Date of Patent: Oct. 4, 1994

[54] COMBINATION SPONGE AND HANDLE

[76] Inventor: Charles E. Townsend, Jr., 11 Ranch Rd., Orinda, Calif. 94563

[21] Appl. No.: 107,386

[22] Filed: Aug. 16, 1993

[51] Int. Cl.[5] ..... A47L 13/12

[52] U.S. Cl. ..... 15/114; 15/105; 15/113; 15/210.1; 15/244.1

[58] Field of Search ..... 15/105, 113, 114, 209.1, 15/210.1, 211, 228, 244.1–244.4

[56] References Cited

U.S. PATENT DOCUMENTS

| | | | |
|---|---|---|---|
| 1,757,366 | 5/1930 | Hertzberg | 15/114 |
| 2,303,660 | 12/1942 | Schickel | 15/244.1 |
| 2,555,858 | 6/1951 | Olesky | 15/244.1 |
| 2,738,529 | 3/1956 | Bernet | 15/244.1 |
| 2,908,930 | 10/1959 | Beck | 15/210.1 |
| 2,941,225 | 6/1960 | Paul | 15/244.1 |
| 2,977,625 | 4/1961 | Hopkins | 15/244.1 |
| 3,058,139 | 10/1962 | Dryden | 15/244.1 |
| 3,188,675 | 6/1965 | Beck | 15/210.1 |
| 3,231,921 | 2/1966 | Cuervo | 15/244.1 |
| 3,262,459 | 7/1966 | Sheehan | 15/244.1 |
| 3,274,635 | 9/1966 | Myers | 15/244.2 |
| 3,317,944 | 5/1967 | Napier, Sr. et al. | 15/244.1 |
| 4,856,136 | 8/1989 | Janssen | 15/244.1 |
| 5,214,820 | 6/1993 | Shumway et al. | 15/244.1 |

FOREIGN PATENT DOCUMENTS

| | | | |
|---|---|---|---|
| 528464 | 3/1954 | Belgium | 15/114 |
| 2513657 | 10/1976 | Fed. Rep. of Germany | 15/244.3 |
| 1168829 | 9/1958 | France | 15/244.1 |
| 291675 | 6/1928 | United Kingdom | 15/244.1 |
| 354636 | 8/1931 | United Kingdom | 15/105 |

*Primary Examiner*—Timothy F. Simone
*Assistant Examiner*—Mark Spisich
*Attorney, Agent, or Firm*—Charles E. Townsend, Jr.

[57] ABSTRACT

A sponge body of between 6"–12" long and square in transverse cross-section defining four 2" to 3" wide side surfaces is provided with an elongate handle, the inner end of which terminates approximately 1" to 2" short of the outer squared end of the sponge body which is formed with two perpendicular transverse notches providing a physical and visual guide for the sponge end to conform with moldings and to compressibly fit into tight spaces. The outer end of the handle terminates in a flared scraper blade. In a modified embodiment, the sponge end of the handle is formed with a brush element having bristles extending laterally beyond the plane of one side surface of the sponge.

9 Claims, 2 Drawing Sheets

COMBINATION SPONGE AND HANDLE

INTRODUCTION

This invention relates to what generically might be termed a combination sponge and handle—it being understood that the "sponge" part is of a synthetic material—i.e., a foam plastic, and that may be used in various practical modes such as a wet, damp or dry sponge.

SUMMARY OF THE INVENTION

In one preferred embodiment, the present invention comprises an elongate sponge body—e.g., 6" to 12" in length—made of soft textured hydrophilic foam plastic material. The sponge body is formed with a square transverse cross section providing 4 flat side wiping surfaces of equal length and width dimensions, and with the outer end of the sponge body providing an effective fifth wiping surface.

The sponge body is preformed with a longitudinal hole or bore of pre-selected diameter extending through the entire length of the elongate sponge body. A handle of preferably somewhat larger diameter than the bore defines a hand grip portion and a sponge support portion—the latter extending into the bore from one end of the sponge body and terminating a predetermined distance short of the outer extremity of the sponge body defining an outer unsupported squishy sponge end portion.

In a preferred embodiment, the outer unsupported squishy end portion of the sponge is cut square to define a fifth flat cleaning surface in addition to the 4 side cleaning surfaces above mentioned. Further, the outer sponge end is formed with at least one transverse groove or notch which permits the surrounding sponge surfaces to more easily surround and conform to convex moldings, trim, shelf edges and the like. Further, because the one or more notches provides notched void or relief areas criss-crossing the end of the sponge, the sponge end is more compressibly conformable into concave areas and tight corners such as when inserting the sponge into cups or drinking glasses, and such as when sponge mopping tight sink or tub corners or other tight spaces as exemplified by auto body trim and the like.

A special feature of the combination sponge mop and handle, is that the outer end of the handle grip portion thereof is formed of substantive rigid plastic (such as injection molded polypropylene) which is specially designed, engineered and molded to provide one or more scouring blade surfaces. In the embodiment shown and to be described, the outer end of the hand grip portion is made of extrusion molded polyethylene in the shape of a double bevel chisel or putty knife. The blade edge is relatively dull so as not to accidentally cut the hand of a user, but is sharp and rigid enough to act as an efficient scraper on virtually any flat surface to scrape off hardened food deposits, burnt spots on frying pans, hardened soap or toothpaste deposits on sinks and countertops and the like. The material is rigid to the feel but is inherently soft enough not to snatch any surface that would be otherwise scoured including plastic finishes, wood surfaces, teflon coated pots and pans, automobile finishes, and the like.

DESCRIPTION OF THE PRIOR ART

Although it is known to provide sponge bodies with handles, I am unaware of any which is constructed so as to provide all of the basic and essential structural and functional features of the present invention as will hereinafter be described and claimed.

OBJECTS AND ADVANTAGES OF THE INVENTION

The following are some of the major objects and advantages of the invention as designed and constructed in a single unitary unit.

The elongate sponge, (preferably between 6" to 12" long) also preferably substantially square in cross section, plus the flat grooved and unsupported end of the sponge provides five clean sides for a user to wet mop, damp mop or dust mop before having to rinse or clean the unit. By contrast, conventional rectangular hand held sink sponges while presenting top and bottom relatively large sponge surfaces in conjunction with two end and two side surfaces present the user with the alternative choices of (1) mopping debris up with a first flat surface only and then rinsing the debris from that surface, or (2) alternatively turning the sponge upside down and continuing to mop up slop or debris with the second flat surface before rinsing the dirtied first side. The latter choice is seldom acceptable to the ordinary user because he or she will now have to put his or her hand on the mopped up slop or debris accumulated on the sponge by the first mopping operation. As a consequence, after a single mopping operation with a conventional rectangular hand sponge, the user will find it either necessary or desirable to rinse the sponge and start anew. As above indicated, a sponge mop according to the present invention presents five clean sides (including the end portion) before having to rinse.

Another unique feature of the present invention resides in the sculpted end of the sponge which, in the preferred embodiment, is characterized by defining a hollow (unsupported) bore in conjunction with four V-shaped notches at 90° angles in opposite side alignment. The sponge end, being unsupported by the handle for its outer 1"-2" in length, and provided with the aligned notches permits the user to manipulate the sponged end along contoured moldings and trim and also such that the sponge easily conforms and wipes clean tight corners protruding sink and bathroom fixtures, automobile grill work and trim work and the like. The V-shaped notches, aforementioned, provide both a visual guide to a user for tracking the sponged end along moldings and trim, and at the same time the slots both conform the sponge over the trim or moldings and actually physically help to maintain the sponge on track without wobbling from one side to the other during the wiping process. It may be noted that in using the slotted end portion of the sponge to perform the aforementioned task, the user will actually use more of a "paintbrush" kind of stroke as compared to the usual across-the-board wiping motion that one would naturally use with a conventional hand sponge.

Another object and objective of the present invention is that by making the sponge within some predetermined practical dimensions as will be stated, the area of each of the four sides can be made large enough to roughly equal the dimensional area of many of the conventional commercial hand sponges. In this connection, sponge mops made in accordance with this invention would include a minimum size of 6" long and 2" each of four sides equals 48 square inches total area plus an additional 4 sq. in. for the squared off but notched end of the sponge which provides, as aforementioned, the fifth discrete cleaning surface. In short, the total sponge area of the recommended minimum size of the present invention provides 52 square inches of sponged area to mop up countertop debris, sink slop or other spills or deposits without the user having to ever touch his or her hands to the sponge itself except when it comes to squeezing the sponge dry after rinsing the dirt off all four sides under a running faucet as is more or less standard practice without using any kind of wet sponge mopping. By contrast to the minimum of 52 square inches of clean sponge area before having to rinse commercially marketed sink and bathroom hand sponges vary in size from approximately 9–18 sq. in. per flat side. Although theoretically the conventional hand sponge provides two opposite flat mopping surfaces of equal dimension, there appears to be a general reluctance on the part of ordinary consumes to mop up slop or debris on one side and then turn the sponge over and put one's hand in such slop to take advantage of the second available clean flat surface before rinsing. Therefore, for most practical purposes, it can be observed that a sink and bathroom sponge made in accordance with the recommended minimum standard dimensions embodying the present invention provides 52 square inches of clean sponge surface before having to rinse, compared to the "one sided" utility of hand sponges providing a surface area of around 9–18 sq. in.

There is also a recommended maximum dimensional structure for products embodying the present invention, namely 12" (length)×3" each of four sides plus (3"×3" equals 9") end surface area equals 153 square inches of clean surface area before having to rinse. A sponge mop made in this larger dimension has been found practically speaking ideal for use in many household or janitorial chores such as cleaning or washing tubs, shower stalls, windows, autos, patio furniture, pool tile, boats, house trailers and the like. Regardless of the dimensional size that a sponge mop embodying the present invention may be made, each provides the advantages and features heretofore mentioned.

It may be further mentioned that especially in the larger sizes of the sponge mop, the various chores above mentioned may be performed in a much easier and more comfortable way than is possible in using more conventional hand sponges regardless of size. For example, the fact that the sponge mop has a handle of substantial length—i.e., 12" to 18" or more, permits the user to wash windows, clean out the bathtubs, sponge off patio furniture, wash cars or the like with a minimum of bending or stooping. In cleaning large areas such as patio tables and benches, shower walls, floors, automobiles, minimizes the number of times that the sponge has to be rinsed in order to provide a continuum of clean sponge surfaces. The same notched end structure of the larger size is especially suitable for sponge mopping, using "paintbrush" type strokes, both smooth and irregular vertical surface areas such as the sides, grill work, trim and wheels of automobiles, the vertical surface of patio furniture including table and chair legs, vertical window trim and casements, and the like.

In the preferred embodiment of the present invention, the outer end portion of the handle terminates in a plastic scraper blade that can be safely used on virtually used on any surface to scrape off food or soap deposits from dishes and countertops; bird droppings, pitch and tar from patio furniture, boats, trailers, autos; and other unwanted surfaced deposits. To a large extent, the handle blade according to the present invention can be used in substitution for conventional scouring pads, rubbing compounds and the like.

In a modified form of the invention, the handle not only functions to mount a sponge unit but also mounts a brush element providing laterally extending bristles projecting outwardly beyond the plane of one side of the rectangular sponge component above described. As will be described in more detail in reference to the accompanying drawings, the combination brush element and surrounding sponge surfaces, both supported by single handle, can be effectively utilized in performing multiple tasks but particularly as a hand manipulated device for scraping and wiping mud and dirt from both the bottom soles of shoes and boots in addition to buffing or wiping surface dust or mud from the top portions of such shoes or boots. The unit may be manipulated without bending or stooping, so the user is to brush and buff his or her shoes without having to remove the shoes from the user's feet. The device of this type is also particularly recommended for golfers to brush debris from their spikes and to buff the top of their golf shoes, by gardeners about to enter an indoor room to first brush and buff the dirt, mud and dust from their gardening shoes, by persons living in snow country to brush off snow from their boots or shoes before tramping into some inside area.

In the preferred embodiment as will be described, the handle portion, the scraper blade, and the thistled brush element may be made from a single plastic extrusion utilizing the same plastic composition such as, for example, a standard polypropylene plastic. Numerous other objects, advantages and features of the present invention will become apparent upon reading the following specification and referring to the accompanying drawings.

Further objects and advantages of the present invention will become apparent upon referring to the accompanying specification and referring to the drawings in which corresponding parts are numbered similarly in each of the several views.

Figure 1:
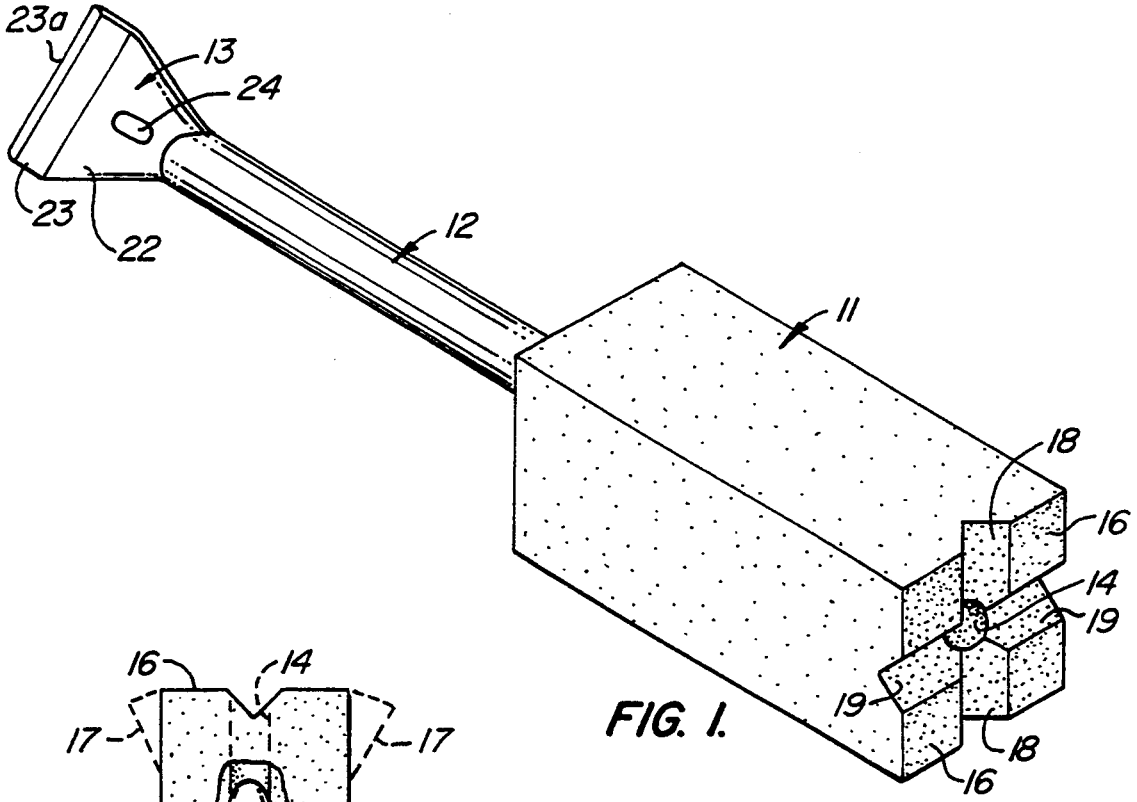
FIG. 1 is a longitudinal perspective view of the invention.
Figure 2:
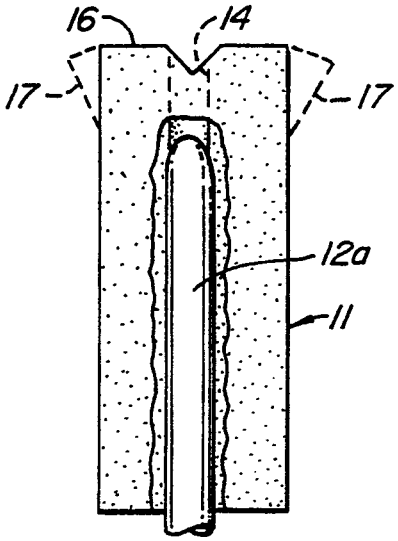
FIG. 2 is a front end elevational view of same.
Figure 2:
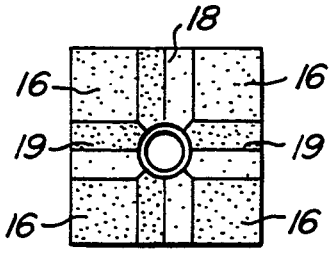

Referring now more specifically to the drawings, FIG. 1 shows the combination of an elongate hydrophilic foam plastic spongelike material indicated generally at 11, a handle indicated generally at 12, and a scraper blade segment indicated generally at 13. The sponge element 11 is formed with a hollow bore 14 into which handle 12 is partially inserted as shown in FIG. 3.

Figure 3:
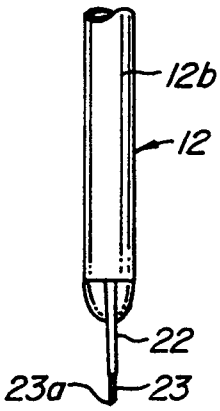
FIG. 3 is a longitudinal side elevational view with portions cut away.

More specifically, FIG. 3 shows in cutaway the handle 12 inserted into the sponge to a point that terminates 1"–2" short of the end surface 16 of the sponge. That part of the handle **12*a* which is inserted into the bore of the sponge is held securely in place as by suitable adhesive (not shown) and firmly and relatively rigidly supports the sponge from its interior throughout the majority of the sponge length. This portion of the handle 12***a* will sometimes be referred to as a "sponge supporting portion" of the handle. The part of the handle which protects exteriorally of the rear end of the sponge 12*b* will sometimes be referred to hereinafter as the "hand grip portion."

As will be particularly seen in FIG. 3, the tip end of the sponge supporting portion of the handle is formed in a gently curved oval shape for the purpose of permitting the unsupported outer end extremities of the sponge to flex in any direction around a curved radius so as to minimize the danger of the sponge weakening or rupturing as if the sponge handle terminated in a straight, non-curvatured butt end. The flexing of the unsupported outer end extremities of the sponge is in any direction is diagrammatically illustrated by the dotted lines 17 as shown in FIG. 3.

Figure 4:
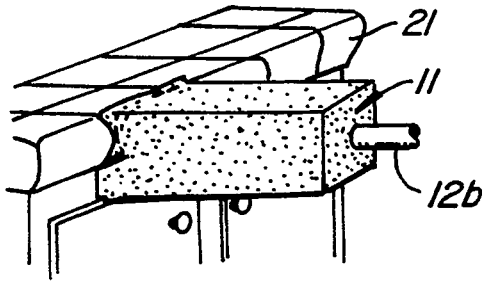
FIG. 4 is a fragmentary perspective view illustrating use of the invention in engaging and cleaning an abutting counter top molding.
Figure 5:
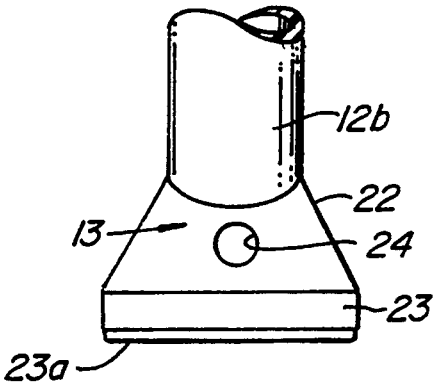
FIG. 5 is an enlarged front elevational fragmentary view of the scraper blade.

The outer end 16 of the sponge is formed with two transverse perpendicularly opposed notches 18 and 19 which intersect at the termination of the hollow bore 14. This sculpted arrangement provides several important functional purposes. Firstly, the notches 18–19 provide both a physical trackway as well as a visual guideline for a user to wipe or glide the end of the sponge along outwardly projecting moldings and trim such as are commonly encountered in sinks, countertops, auto trim, grill work, furniture, house moldings and the like. FIG. 4 diagrammatically illustrates how the notched sponge end conforms itself and literally envelops the sponge end over an outwardly protruding tile countertop edge 21, for example.

Additionally, the sculpted outer end of the sponge provides for desired flexibility and compressibility of the sponge end in terms of various uses and chores to be performed. For example, the hollow bore in conjunction with the notches at the outer end provides void relief areas whereby the end of the sponge can more easily flex and compress inwardly to fit into tight corners or confined spaces such as rinsing out glassware or other types of vessels. The combined flexibility and compressibility of the sponge end permits the user to manipulate the tool with what might be analogized to "paint brush" strokes to wash or dust mop around bathroom fixtures, tight shelving spaces, refrigerator interiors, stove top configurations and the like. In a preferred practical embodiments of the invention, the length of the sponge 11 is recommended to be not substantially less than 6" and not substantially greater than 12". The four sides of the sponge in smaller size is recommended to be approximately 2" to 2½ each side and for the larger or 12" longer model from 2" to not more than 3½ per side. Because the sponge element is rectangular, and preferably substantially square in cross section, it is apparent that a user in wiping off a countertop, for example, can start with a first side to start mopping or cleaning slop or debris and when this first side becomes saturated to simply rotate the sponge 90° and continue with a second clean side and so on until four sides have been dirtied before having to rinse. In actuality, there are five available clean sides if one is to consider the substantial end surface area 16 of the sponge which is ideally used for wiping a countertop at its point of joinder to a vertical wainscot or outward molding. In short, for all practical purposes, a sponge embodying the present invention presents five clean surfaces before having to rinse or otherwise cleanse any of the sponge areas.

The outer end of the hand grip portion 12*b* of the handle 12 preferably terminates in a blade structure as indicated at 13. This blade structure may be formed as an integral part of an extrusion molded plastic handle such as a handle extruded from polypropylene, polyethylene, or nylon by way of examples. The blade portion 13 more specifically consists of a flared body portion 22 which terminates in a scraper blade element 23. In the preferred embodiment, the outwardly flared body portion 22 can be made of constant thickness such as, for example, 1/18" thickness. The blade 23 can be tapered to present a final blade tip 23*a* of 1/32" thickness. It has been found that a plastic blade of these thickness dimensions can be used to very efficiently yet safely scrape off many kinds of deposits from many kinds of surfaces as all is heretofore suggested.

In FIG. 1, the body portion 22 is shown as formed with an aperture 24 for convenience in both hanging the unit from a display rack as well as permitting the user to hang the unit from a hook or nail at some convenient location when not in use.

Figure 6:
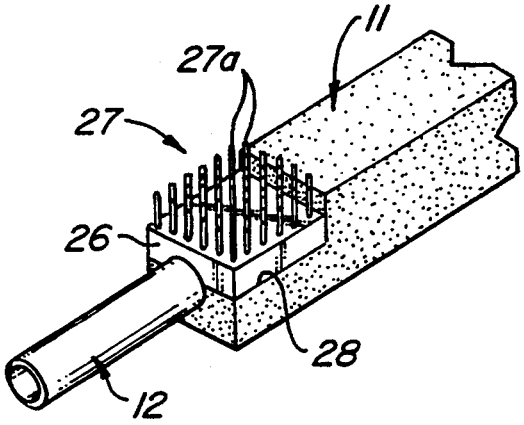
FIG. 6 is a longitudinal plan perspective view of a modified embodiment of the invention.

FIG. 6 shows a modified form of the invention which may be considered identical in all respects to that which has been described in reference to FIGS. 1–5, inclusive. In FIG. 6, there is provided a mounting base 26 upon which supports a brush element indicated generally at 27. The mounting pad 26 is preferably made as an integral part of the handle 12 extrusion, although it is understood that a pad for mounting a brush could be made separately and mechanically attached to the handle by conventional fasteners or adhesive if so desired. Further, in the preferred embodiment, the individual upwardly extending thistles 27*a* which make up the brush element 27 are preferably also integrally extrusion molded as a part of the handle extrusion. In short, the handle 12, the pad 26 including the brush element 27 are all formed integral of the same material in one extrusion molding operation.

The sponge element 11 is suitably notched at its rearward extremities, as at 28 to accommodate the mounting pad 26 and brush element 27. The thistles 27*a* are made of such length as to project laterally above or beyond the plane of the adjacent sponge surface 11 to permit a user to briskly brush an article without simultaneously contacting the article with any of the sponge portion of the tool.

Figure 7:
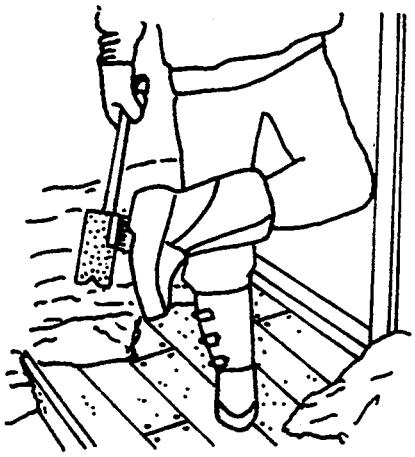
FIG. 7 is a fragmentary view of how the modified tool of FIG. 6 may be used to clean snow from the bottom soles of outdoor boots at an entryway.

FIG. 7 demonstrates how the modified unit of FIG. 6 may be manipulated by a person in a standing position, and without the person having to remove his boots, in such way as to brush off mud or sleet from the bottom of his boots. After the brush has removed at least a major of the debris from the bottom of the shoes, the user can by rotating the handle 90° to 180°, use the sponge 11 as a soft buffer to buff the remaining dirt off the soles as well as to buff the sides and tops of the boots. This particular tool can of course to clean off dirt, mud, grass, sand, or other soilants from both the soles and shoe tops of gardeners, golfers (spikes), and the like.

Although the present invention has been described in some detail by way of illustration and example, it is understood that other embodiments, modifications may be made within the skill of the art and is limited only by the legal scope of the claims annexed hereto.

What is claimed is:

1. The combination of a sponge mop with handle comprising:

an elongate sponge body having a length exceeding 3" and which in transverse section defines at least three flat side surfaces of substantially the same length;

said sponge body preformed with a central bore of uniform diameter extending the full length through the sponge body;

an elongated handle of preselected length and having a slightly larger diameter than said bore; said handle defining an exposed hand grip portion and a sponge supporting portion extending into the bore from a first end of said sponge body to a point not less than substantially ¾" inwardly from a second and opposite end of the sponge body;

the portion of the bored sponge located between the sponge supporting portion of the handle and the outermost surface of the second end of the sponge body defining an unsupported squishy end portion sponge mass compressibly conformable through manual manipulation of the exposed handle to conform itself to irregular and contoured surfaces, said second end portion of said sponge formed with at least one elongated notched groove extending from a first point on one flat side to a point on a side of the sponge body opposite the first point of said sponge with said notched groove being oriented substantially transverse to the longitudinal axis of the sponge body; said groove providing a visible sight line to assist a user to engage and follow along molded trim and similar surfaces, the sides of said groove also providing a physical trackway for slidably and compressively conformably engaging edges of trim and moldings during back and forth wiping operations, the notched depth of the said groove being less than the spacing between the end of the sponge supporting portion of the handle and the second end surface of the sponge whereby no part of the groove intersects with the handle in the bore.

2. The combination of claim 1 and wherein said elongate sponge body is substantially rectangular in cross-section defining four flat side surfaces of substantially the same length.

3. The combination of claim 2 and wherein the said squishy end portion of the sponge is formed with two perpendicularly oriented substantially V-shaped grooves each extending entirely across one side surface to an opposite side surface of the outer end of the sponge and each providing a visual and physical guide for brush stroking convex surfaces such as trim moldings.

4. The combination of claim 2 and wherein the squishy end of the sponge is notched from all four sides of the rectangular cross section to connect with the bore of the sponge providing multiple visual and physical guides.

5. The combination of claim 1 and wherein the end of the hand grip portion opposite the sponge supporting portion is structurally shaped and configured to form a scraper blade.

6. A combination sponge body and handle comprising: an elongate handle defining an upper exposed hand grip portion, and a lower brush and buffing material mounting portion;

a brush element mounted on said handle mounting portion including a plurality of bristles projecting laterally outwardly from a first side of said handle mounting portion;

and an elongate body of soft buffing material affixed to said mounting portion of said handle adjacent said brush element;

said buffing material affixedly mounted on said mounting portion to project outwardly from both the said first side and from a second side opposite the first side of said handle mounting portion;

a substantial portion of said buffing material being mounted on and encasing the lower end portion of said handle at a location on said handle below a lowermost portion of said brush element;

that portion of the buffering material mounted on the first side of said handle projecting outwardly therefrom a distance substantially less than the laterally outwardly projecting length of said bristles.

7. The combination of claim 6 wherein said buffing material is rectangular in cross-section defining four substantially flat sides each projecting laterally outwardly from said lower handle mounting portion.

8. The combination of claim 6 and wherein said buffing material is formed of a relatively soft, tough, and sponge-like plastic foam material.

9. The combination of claim 6 and wherein a lower end portion of said buffing material projects below a lower terminal end of the mounting portion of said handle defining an unsupported flexible and compressible sponge mass;

said lower end of the buffing material being formed with at least one transverse groove extending from one side to a second and opposite side thereof defining a visible sight line to assist the user to engage and follow along irregular and contoured surfaces, and wherein said groove further provides a physical trackway to compressibly slidably engage such irregular and contoured surfaces.

* * * * *